US008955220B2

(12) United States Patent
Scancarello et al.

(10) Patent No.: US 8,955,220 B2
(45) Date of Patent: Feb. 17, 2015

(54) POWDER METAL SCROLLS AND SINTER-BRAZING METHODS FOR MAKING THE SAME

(75) Inventors: Marc J. Scancarello, Troy, OH (US); Roxana E. L. Ruxanda, Troy, OH (US)

(73) Assignee: Emerson Climate Technologies, Inc., Sidney, OH (US)

( * ) Notice: Subject to any disclaimer, the term of this patent is extended or adjusted under 35 U.S.C. 154(b) by 908 days.

(21) Appl. No.: 12/720,853

(22) Filed: Mar. 10, 2010

(65) Prior Publication Data

US 2010/0229386 A1 Sep. 16, 2010

Related U.S. Application Data

(60) Provisional application No. 61/159,234, filed on Mar. 11, 2009.

(51) Int. Cl.
*B23K 1/19* (2006.01)
*C22C 33/02* (2006.01)
(Continued)

(52) U.S. Cl.
CPC ..... *C22C 33/0264* (2013.01); *B22F 7/064* (2013.01); *F04C 18/0253* (2013.01); *B22F 2005/004* (2013.01); *F04C 2230/22* (2013.01); *F04C 2230/231* (2013.01)
USPC ..... 29/888.022; 29/888.02; 419/45; 419/46

(58) Field of Classification Search
CPC ..... B23P 15/00; B22F 3/001; B22F 3/10; B22F 3/1017; B22F 3/11; B22F 3/12; B22F 3/16; B22F 5/00; B22F 7/00; B22F 2205/004; B22F 2005/005
USPC ..... 29/888.02, 888.022; 419/5, 45, 46
See application file for complete search history.

(56) References Cited

U.S. PATENT DOCUMENTS 3,600,114 A 8/1971 Dvorak et al.
3,889,349 A 6/1975 Kaufman
(Continued)

FOREIGN PATENT DOCUMENTS

AU 2002325600 8/2003
AU 2008202166 5/2011
(Continued)

OTHER PUBLICATIONS

International Search Report regarding International Application No. PCT/US2010/026902, dated Oct. 26, 2010.
(Continued)

*Primary Examiner* — Christopher Besler
(74) *Attorney, Agent, or Firm* — Harness, Dickey & Pierce, P.L.C.

(57) ABSTRACT

Methods of forming scroll compressor components are provided. The methods include forming at least one component of a scroll member from a powder metallurgy technique and joining the component with another distinct component via a sinter-brazing process. For example, a baseplate having a spiral scroll involute is joined to a hub via a joint interface having brazing material to form a braze joint with superior quality. At least one component is formed from a powder metal material including carbon and at least one species that reacts with or binds carbon to prevent migration during brazing of the sinter-brazing heat process. Optionally, during the powder metallurgy process, an alloy with a lower concentration of carbon is selected, which may be incorporated into a crystal structure with the species that prevents carbon migration.

20 Claims, 8 Drawing Sheets

(51) Int. Cl.

| | |
|---|---|
| ***B22F 7/06*** | (2006.01) |
| ***F04C 18/02*** | (2006.01) |
| *B22F 5/00* | (2006.01) |

(56) References Cited

U.S. PATENT DOCUMENTS

| | | | | |
|---|---|---|---|---|
| 3,935,340 | A | 1/1976 | Yamaguchi et al. | |
| 4,029,476 | A | 6/1977 | Knopp | |
| 4,197,118 | A | 4/1980 | Wiech, Jr. | |
| 4,550,480 | A | 11/1985 | Tanikawa et al. | |
| 4,838,936 | A | 6/1989 | Akechi | |
| 4,877,382 | A | 10/1989 | Caillat et al. | |
| 4,944,663 | A | 7/1990 | Iizuka et al. | |
| 4,958,993 | A | 9/1990 | Fujio | |
| 5,044,904 | A | 9/1991 | Richardson, Jr. | |
| 5,051,079 | A | 9/1991 | Richardson, Jr. | |
| 5,102,316 | A | 4/1992 | Caillat et al. | |
| 5,156,321 | A * | 10/1992 | Liburdi et al. | 228/119 |
| 5,156,539 | A | 10/1992 | Anderson et al. | |
| 5,278,250 | A | 1/1994 | Ohtani et al. | |
| 5,320,506 | A | 6/1994 | Fogt | |
| 5,392,512 | A | 2/1995 | Fann et al. | |
| 5,478,220 | A | 12/1995 | Kamitsuma et al. | |
| 5,492,460 | A | 2/1996 | Takeda et al. | |
| RE35,216 | E | 4/1996 | Anderson et al. | |
| 5,511,959 | A | 4/1996 | Tojo et al. | |
| 5,534,220 | A | 7/1996 | Purnell et al. | |
| 5,580,401 | A | 12/1996 | Williamson | |
| 5,594,186 | A | 1/1997 | Krause et al. | |
| 5,759,298 | A | 6/1998 | Williamson | |
| 6,033,788 | A | 3/2000 | Cawley | |
| 6,045,601 | A | 4/2000 | Tan | |
| 6,051,184 | A | 4/2000 | Kankawa | |
| 6,079,962 | A | 6/2000 | Seibel et al. | |
| 6,106,252 | A | 8/2000 | Yamanaka et al. | |
| 6,129,530 | A | 10/2000 | Shaffer | |
| 6,139,294 | A | 10/2000 | Haller | |
| 6,139,295 | A | 10/2000 | Utter et al. | |
| 6,143,241 | A | 11/2000 | Hajaligol et al. | |
| 6,146,118 | A | 11/2000 | Haller et al. | |
| 6,171,084 | B1 | 1/2001 | Wallis et al. | |
| 6,176,094 | B1 | 1/2001 | Ohta et al. | |
| 6,196,814 | B1 | 3/2001 | Cooksey et al. | |
| 6,299,424 | B1 | 10/2001 | Futagami et al. | |
| 6,302,665 | B1 | 10/2001 | Esumi et al. | |
| 6,332,904 | B1 | 12/2001 | Fujiki et al. | |
| 6,358,298 | B1 | 3/2002 | Gagné et al. | |
| 6,572,352 | B2 | 6/2003 | Reinhart | |
| 6,705,848 | B2 | 3/2004 | Scancarello | |
| 6,766,817 | B2 | 7/2004 | da Silva | |
| 7,086,151 | B2 | 8/2006 | Scancarello | |
| 7,285,255 | B2 | 10/2007 | Kadlec et al. | |
| 7,377,904 | B2 | 5/2008 | Conway et al. | |
| 7,819,822 | B2 | 10/2010 | Calasso et al. | |
| 7,845,918 | B2 | 12/2010 | Scancarello | |
| 7,963,752 | B2 | 6/2011 | Stover et al. | |
| 8,568,117 | B2 | 10/2013 | Scancarello | |
| 8,684,711 | B2 | 4/2014 | Stover et al. | |
| 2002/0025269 | A1 | 2/2002 | Esumi et al. | |
| 2003/0062396 | A1 * | 4/2003 | Kovacich | 228/56.3 |
| 2003/0138339 | A1 | 7/2003 | Scancarello | |
| 2005/0274223 | A1 * | 12/2005 | Schade et al. | 75/252 |
| 2006/0093498 | A1 | 5/2006 | Kim | |
| 2006/0180640 | A1 * | 8/2006 | Ariga et al. | 228/262.9 |
| 2008/0075622 | A1 * | 3/2008 | Sakata et al. | 419/41 |
| 2008/0181801 | A1 | 7/2008 | Stover et al. | |
| 2011/0052410 | A1 | 3/2011 | Scancarello | |
| 2011/0229360 | A1 | 9/2011 | Stover et al. | |

FOREIGN PATENT DOCUMENTS

| | | |
|---|---|---|
| CN | 1270661 | 10/2000 |
| CN | 1275456 | 12/2000 |
| CN | ZL02141404.1 | 7/2008 |
| CN | 101275567 | 10/2008 |
| CN | 101548107 | 9/2009 |
| CN | 102348898 | 2/2012 |
| EP | 0053301 | 6/1982 |
| EP | 0508293 | 10/1992 |
| EP | 0296552 | 5/1993 |
| EP | 0561343 | 1/1997 |
| EP | 1331395 | 7/2003 |
| EP | 1500818 | 1/2005 |
| EP | 2111508 | 10/2009 |
| EP | 2282060 | 2/2011 |
| JP | 4978733 | 7/1974 |
| JP | 57-135291 | 8/1982 |
| JP | 58-126492 | 7/1983 |
| JP | 58-210392 | 12/1983 |
| JP | 59-192881 | 11/1984 |
| JP | 61-226584 | 10/1986 |
| JP | 61-226589 | 10/1986 |
| JP | 62-003188 | 1/1987 |
| JP | 02-133549 | 5/1990 |
| JP | 02-151341 | 6/1990 |
| JP | 02-173378 | 7/1990 |
| JP | 03-294682 | 12/1991 |
| JP | 05-51707 | 3/1993 |
| JP | 05-051708 | 3/1993 |
| JP | 05-161947 | 6/1993 |
| JP | 06-128666 | 5/1994 |
| JP | 07-090323 | 4/1995 |
| JP | 07-090324 | 4/1995 |
| JP | 07-090510 | 4/1995 |
| JP | 07-090511 | 4/1995 |
| JP | 07-090512 | 4/1995 |
| JP | 07-180681 | 7/1995 |
| JP | 07-188829 | 7/1995 |
| JP | 07-197213 | 8/1995 |
| JP | 07-299532 | 11/1995 |
| JP | 09-032747 | 2/1997 |
| JP | 09-073847 | 3/1997 |
| JP | 09-324771 | 12/1997 |
| JP | 10-272559 | 10/1998 |
| JP | 11-279676 | 10/1999 |
| JP | 11-336674 | 12/1999 |
| JP | 2000-271757 | 10/2000 |
| JP | 2000-294665 | 10/2000 |
| JP | 2001081501 | 3/2001 |
| JP | 2001081522 | 3/2001 |
| JP | 2001-115958 | 4/2001 |
| JP | 2001131677 | 5/2001 |
| JP | 2001-234305 | 8/2001 |
| JP | 2001-276967 | 10/2001 |
| JP | 2003214365 | 7/2003 |
| JP | 2007-090323 | 4/2007 |
| KR | 10-1999-0060809 | 7/1999 |
| KR | 2001-0063927 | 7/2001 |
| KR | 10-2003-0064251 | 7/2003 |
| KR | 10-2006-0039180 | 5/2006 |
| KR | 10-0886112 | 2/2009 |
| KR | 10-2009-0113242 | 10/2009 |
| KR | 20110123803 | 11/2011 |
| TW | I244953 | 12/2005 |
| TW | I252787 | 4/2006 |
| WO | WO 92/20522 | 11/1992 |
| WO | WO 2008/091564 | 7/2008 |
| WO | WO 2010/105007 | 9/2010 |

OTHER PUBLICATIONS

Written Opinion of the International Searching Authority regarding International Application No. PCT/US2010/026902, dated Oct. 26, 2010.

"Powder Metallurgy Handbook," pp. 134-138, (Jul. 1994), Chinese language document cited in Taiwanese Office Action issued Oct. 21, 2003 in Taiwanese Patent Application No. TW91117214 (related to cross-referenced U.S. Appl. No. 12/940,688).

"Materials Standards for PM Structural Parts—MPIF Standard 35," Metal Powder Industries Federation (Rev. 2007).

ASM International Handbook vol. 7, Powder Metal Technologies and Applications, pp. 321-325, 469 and 658-659 (1998).

ASM Materials Engineering Dictionary, ed. J.R. Davis & Associates, pp. 119-120, 177, 373, and 421-422 (1992).

(56) References Cited

OTHER PUBLICATIONS

Communication dated Apr. 11, 2012 issued by the European Patent Office in European Patent Application No. 02255040.4 (published as EP 1331395) (related to cross-referenced U.S. Appl. No. 12/940,688).
Communication dated Apr. 2, 2013 enclosing the European Search Report dated Mar. 19, 2013 issued by the European Patent Office in European Patent Application No. 10011092.3 (published as EP 2282060) (related to cross-referenced U.S. Appl. No. 12/940,688).
Communication dated Dec. 3, 2007 enclosing the European Search Report dated Nov. 20, 2007 issued by the European Patent Office in European Patent Application No. 04024819.7 (published as EP 1500818) (related to cross-referenced U.S. Appl. No. 12/940,688).
Communication dated Feb. 23, 2006 issued by the European Patent Office in European Patent Application No. 02255040.4 (published as EP 1331395) (related to cross-referenced U.S. Appl. No. 12/940,688).
Communication dated Jan. 17, 2012 issued by the European Patent Office in European Patent Application No. 04024819.7 (published as EP 1500818) (related to cross-referenced U.S. Appl. No. 12/940,688).
Communication dated Jul. 28, 2003 enclosing the European Search Report dated Jul. 21, 2003 issued by the European Patent Office in European Patent Application No. 02255040.4 (published as EP 1331395) (related to cross-referenced U.S. Appl. No. 12/940,688).
Communication dated Jul. 7, 2008 issued by the European Patent Office in European Patent Application No. 02255040.4 (published as EP 1331395) (related to cross-referenced U.S. Appl. No. 12/940,688).
Communication dated Jun. 7, 2004 issued by the European Patent Office in European Patent Application No. 02255040.4 (published as EP 1331395) (related to cross-referenced U.S. Appl. No. 12/940,688).
Communication dated Sep. 10, 2012 issued by the European Patent Office in European Patent Application No. 04024819.7 (published as EP 1500818) (related to cross-referenced U.S. Appl. No. 12/940,688).
Decision for Patent Grant issued on Nov. 26, 2008 by the Korean Intellectual Property Office in Korean Patent Application No. 10-2008-0084992 (issued as KR 10-0886112) (related to cross-referenced U.S. Appl. No. 12/940,688).
Examiner's First Report dated Mar. 21, 2007 issued by IP Australia in Australian Patent Application No. 2002325600 (issued as AU 2002325600) (related to cross-referenced U.S. Appl. No. 12/940,688).
Examiner's First Report dated Oct. 20, 2009 issued by IP Australia in Australian Patent Application No. 2008202166 (issued as AU 2008202166) (related to cross-referenced U.S. Appl. No. 12/940,688).
First Office Action dated Oct. 21, 2003 issued by the Intellectual Property Bureau Ministry of Economic Affairs in Taiwanese Patent Application No. 91117214 (issued as TW I244953) (related to cross-referenced U.S. Appl. No. 12/940,688).
First Office Action issued by the Chinese Patent Office on Sep. 25, 2009 regarding Chinese Patent Application No. 200810099173.8 (related to cross-referenced U.S. Appl. No. 12/940,688), summary provided by Unitalen Attorneys at Law.
German, Randall M., et al., "Injection Molding of Metals and Ceramics," Metal Powder Industries Foundation, pp. 315-320 (1997).
International Preliminary Report on Patentability issued on Jul. 28, 2009 for PCT International Application No. PCT/US2008/000749 (published as WO 2008/091564) (related to cross-referenced U.S. Appl. No. 13/117,848).
International Preliminary Report on Patentability issued on Sep. 13, 2011 for related PCT International Application No. PCT/US10/026902 (published as WO 2010/105007).
International Search Report issued on Apr. 28, 2008 for PCT International Application No. PCT/US2008/000749 (published as WO 2008/091564) (related to cross-referenced U.S. Appl. No. 13/117,848).
Notice of Reasons for Rejection dated Nov. 13, 2007 issued by the Japanese Patent Office in Japanese Patent Application No. 2002299020 (published as JP 2003214365) (related to cross-referenced U.S. Appl. No. 12/940,688).
Notification of Grounds for Refusal issued on Jan. 15, 2013 by the Korean Intellectual Property Office for related Korean Patent Application No. 10-2011-7023430 (published as KR 20110123803).
Notification of the First Office Action dated Feb. 23, 2011 issued by the State Intellectual Property Office of People's Republic of China in Chinese Patent Application No. 200880000988.4 (published as CN 101548107) (related to cross-referenced U.S. Appl. No. 13/117,848).
Notification of the First Office Action dated Jul. 7, 2006 issued by the Patent Office of the People's Republic of China in Chinese Patent Application No. 02141404.1 (issued as CN CN ZL02141404.1) (related to cross-referenced U.S. Appl. No. 12/940,688).
Preliminary Notice of Grounds for Rejection issued on May 29, 2008 by the Korean Intellectual Property Office in Korean Patent Application No. 10-2002-0053393 (published as KR 10-0886111) (related to cross-referenced U.S. Appl. No. 12/940,688).
Written Opinion of the International Searching Authority issued on Apr. 28, 2008 for PCT International Application No. PCT/US2008/000749 (published as WO 2008/091564) (related to cross-referenced U.S. Appl. No. 13/117,848).
ASM International Handbook vol. 7, Powder Metal Technologies and Applications, pp. 321-325, 468-503 and 658-659 (1998).
Decision for Patent Grant dated May 20, 2013 issued by the Korean Intellectual Property Office for related Korean Patent Application No. 10-2011-7023430 (published as KR 20110123803).
Notification of the First Office Action dated Oct. 22, 2013 issued by the State Intellectual Property Office of the People's Republic of China for related Chinese Patent Application No. 201080011785.2 (published as CN 102348898).
Restriction Requirement mailed Dec. 10, 2012 in U.S. Appl. No. 12/940,688 (published as US 2011/0052410).
Response to Restriction Requirement mailed Dec. 10, 2012 in U.S. Appl. No. 12/940,688 (published as US 2011/0052410), filed Jan. 10, 2013.
Non-Final Office Action mailed Feb. 5, 2013 in U.S. Appl. No. 12/940,688 (published as US 2011/0052410).
Response to Non-Final Office Action mailed Feb. 5, 2013 in U.S. Appl. No. 12/940,688 (published as US 2011/0052410), filed May 6, 2013.
Notice of Allowance mailed on Jun. 25, 2013 in U.S. Appl. No. 12/940,688 (published as US 2011/0052410).
Supplemental Notice of Allowance mailed on Sep. 13, 2013 in U.S. Appl. No. 12/940,688 (published as US 2011/0052410).
Restriction Requirement mailed Apr. 12, 2013 in U.S. Appl. No. 13/117,848 (published as US 2011/0229360).
Response to Restriction Requirement mailed Apr. 12, 2013 in U.S. Appl. No. 13/117,848 (published as US 2011/0229360), filed May 13, 2013.
Non-Final Office Action mailed Jun. 18, 2013 in U.S. Appl. No. 13/117,848 (published as US 2011/0229360).
Response to Non-Final Office Action mailed Jun. 18, 2013 in U.S. Appl. No. 13/117,848 (published as US 2011/0229360), filed Sep. 18, 2013.
Notice of Allowance mailed on Oct. 30, 2013 in U.S. Patent Application No. 13/117,848 (published as US 2011/0229360).
Supplemental Notice of Allowability mailed on Jan. 8, 2014 in U.S. Patent Application No. 13/117,848 (published as US 2011/0229360).
Second Office Action issued by the State Intellectual Property Office of the People's Republic of China on Jun. 16, 2014 in Chinese App. No. 201080011785.2 (Pub. No. CN 102348898).
Communication issued by the European Patent Office on Jul. 7, 2014 in European App. No. 08713197.5 (Pub. No. EP 2111508 A0) enclosing the Extended European Search Report issued on Jun. 25, 2014.
Communication issued by the European Patent Office on Jul. 24, 2014 in European App. No. 08713197.5 (Pub. No. EP 2111508 A0).

* cited by examiner

POWDER METAL SCROLLS AND SINTER-BRAZING METHODS FOR MAKING THE SAME

This application claims the benefit of U.S. Provisional Application No. 61/159,234, filed on Mar. 11, 2009. The entire disclosure of the above application is incorporated herein by reference.

FIELD

The present teachings relate to scroll machines, and more particularly to a scroll compressor and methods for making components of a scroll compressor.

BACKGROUND

The statements in this section merely provide background information related to the present disclosure and may not constitute prior art.

Scroll-type machines are commonly used as compressors in both refrigeration and air conditioning applications, due primarily to their highly efficient operation. Scroll compressors are commonly formed of ferrous materials. Carbon is often added to materials to provide specific desired properties, such as strength and tribological benefits. For example, graphite can be added to iron powder prior to sintering to provide a sintered object with certain desirable wear properties. However, many metallurgical processes of forming ferrous materials, including powder metallurgy techniques, suffer from the phenomenon of forming certain undesirable carbides. Furthermore, as described in more detail in the present disclosure, the presence of free carbon, like graphite, potentially impacts the quality of joints formed between scroll components, such as braze joints formed during sintering. Thus, it is desirable to form scroll components in a manner that forms superior scroll components and compressors, while minimizing formation of undesirable carbides and enhancing joint quality and ability to easily machine between several components.

SUMMARY

The present teachings are generally directed toward a scroll compressor, and more particularly to the joints of a subassembly formed of a plurality of scroll components for a scroll compressor. In one aspect, a method of forming a scroll member includes disposing a brazing material in a joint interface region formed between a portion of a first scroll component and a portion of a second scroll component, where at least one of the first and second scroll components is formed from a powder metal material. Further, at least one of the first and second scroll components comprises an iron alloy having greater than or equal to about 95% by weight of total carbon present in the iron alloy in a form bound to and/or reacted with a species in the iron alloy that minimizes carbon migration. Then, the first scroll component and the second scroll component having the brazing material therebetween are further processed via a heating process to sinter-braze the first and second scroll components with the brazing material to form the scroll member having a braze joint coupling a portion of the first scroll component to a portion of the second scroll component.

In yet other aspects, the present disclosure contemplates methods of forming a scroll member, which include heating a first scroll component comprising a powder metal material via a first heating process. Then, a brazing material is disposed between a portion of the first scroll component and a portion of a second scroll component. The first and second scroll components are heated to sinter-braze the first and second scroll components having brazing material therebetween via a second heating process to form the scroll member having a braze joint coupling a portion of the first component to a portion of the second component.

In other variations, the present disclosure provides a method of forming a scroll member by compressing a powder metal material comprising iron, copper, graphite, and a distinct lubricant, to form a green hub, where a total carbon content of the powder metal material is greater than or equal to about 0.4% to less than or equal to about 0.6% by weight. The green hub is at least partially sintered in a first sintering process to form a hub structure, thereby incorporating greater than or equal to about 95% of the graphite into one or more stable crystal phases. Then, a brazing material is disposed in a region near a joint interface formed between a portion of a powder metal involute and the hub structure to form a subassembly. Lastly, the subassembly is heat processed to sinter-braze the subassembly to form the scroll member including a braze joint.

Further, in certain variations, the present disclosure provides a scroll component subassembly having a spiral involute scroll component, a baseplate having a first major surface and a second opposing major surface, where the first major surface is coupled to the involute scroll component and the second opposing major surface defines a coupling portion. The scroll component subassembly also includes a hub fastened to the coupling portion of the baseplate by a braze joint, where the hub is formed by powder metallurgy and comprises an alloy comprising iron, carbon, and copper. Prior to coupling the hub to the coupling portion of the baseplate, greater than or equal to about 95% by weight of carbon present in the hub is substantially incorporated into one or more crystal structures formed by iron and/or copper, such as pearlite.

Further areas of applicability of the present teachings will become apparent from the detailed description provided hereinafter. It should be understood that the detailed description and specific examples are intended for purposes of illustration only and are not intended to limit the scope of the claims.

DRAWINGS

The drawings described herein are for illustration purposes only and are not intended to limit the scope of the present disclosure in any way.

The present teachings will become more fully understood from the detailed description and the accompanying drawings, wherein.

Figure 3A:
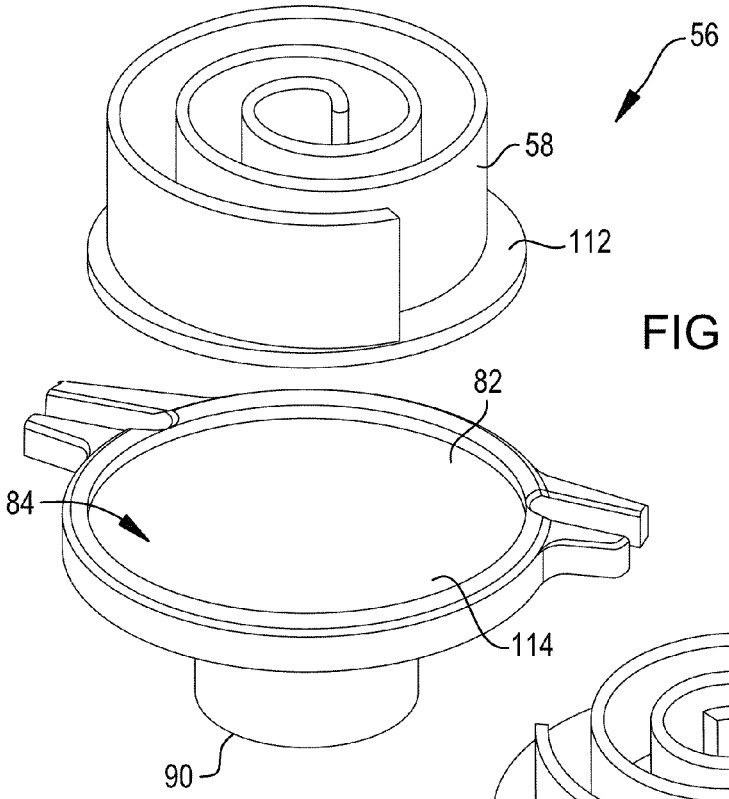
Figure 3B:
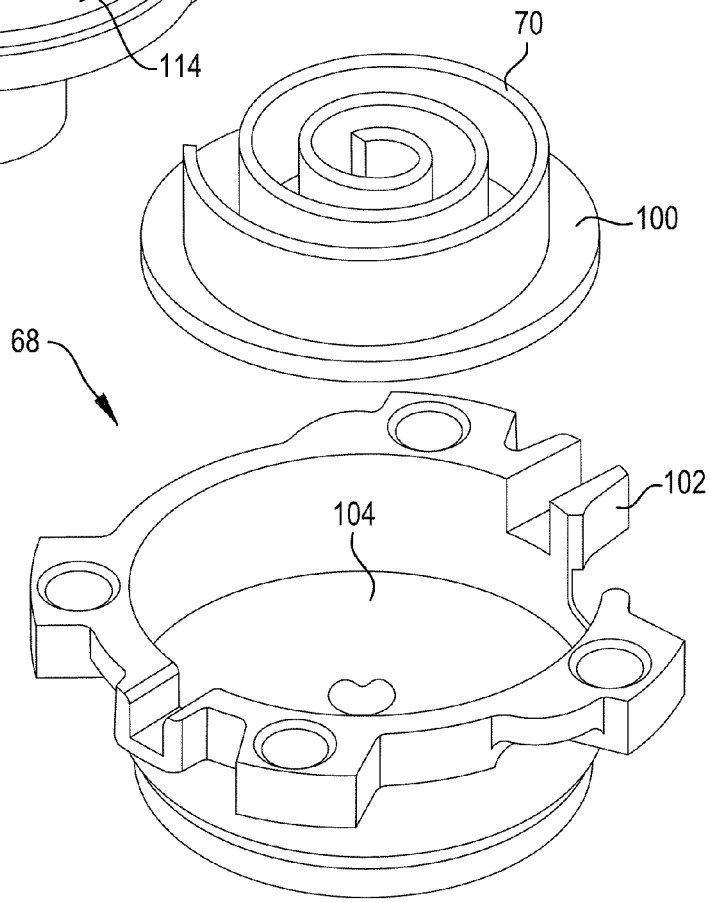
Figure 4A:
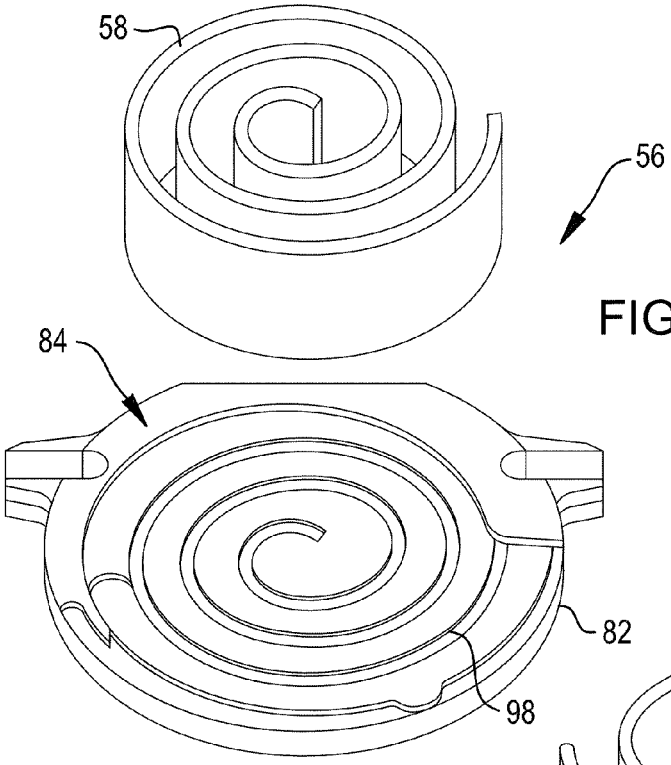
Figure 4B:
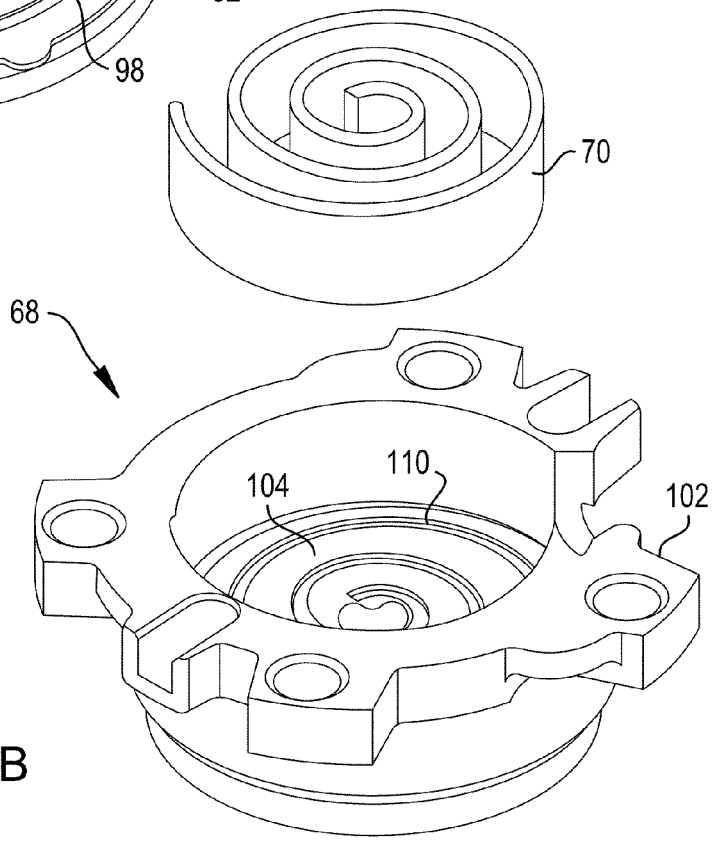
Figure 5:
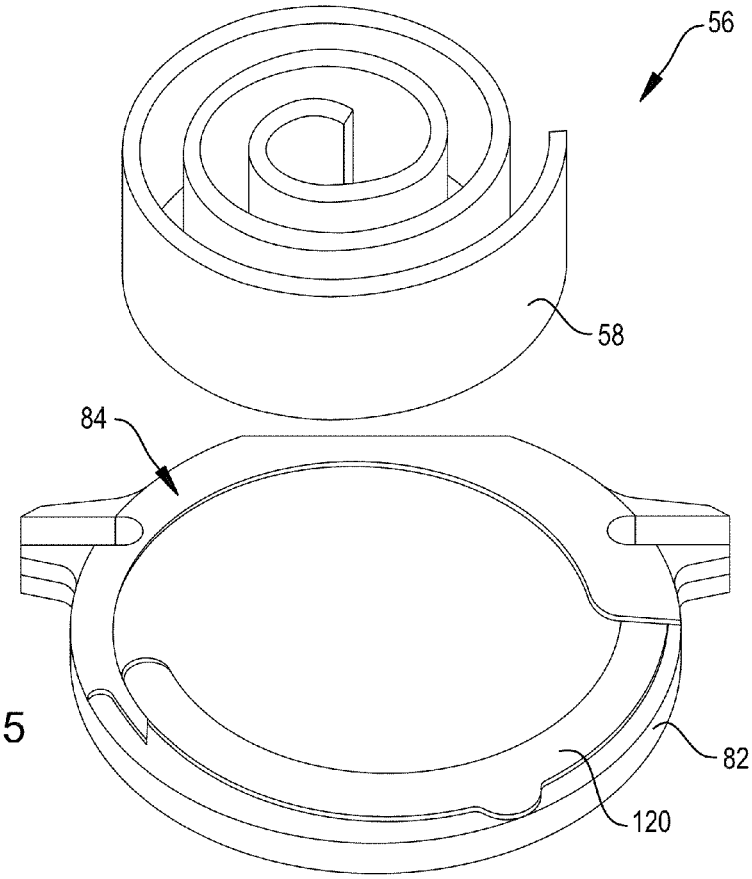
Figure 6:
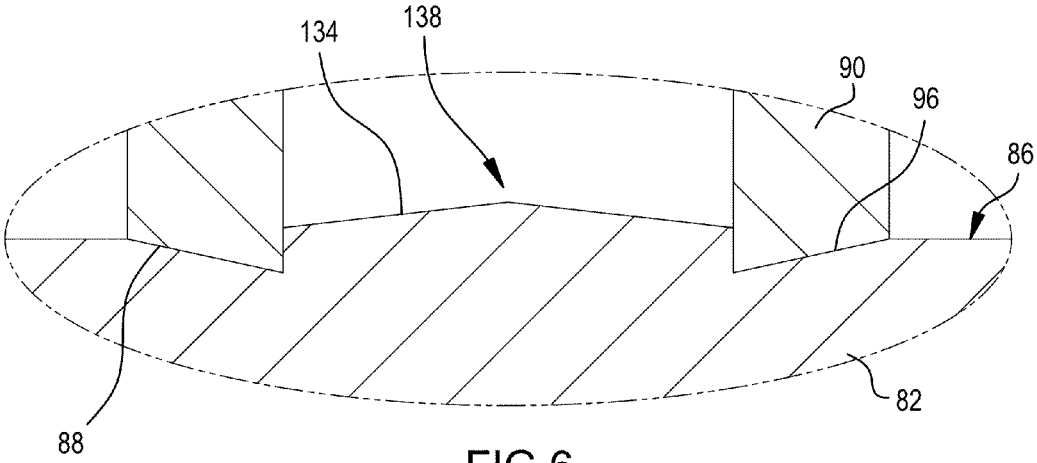
Figure 7:
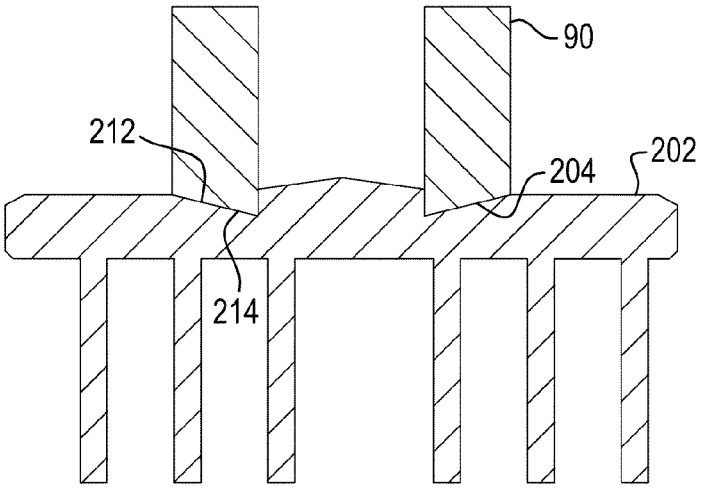
Figure 8:
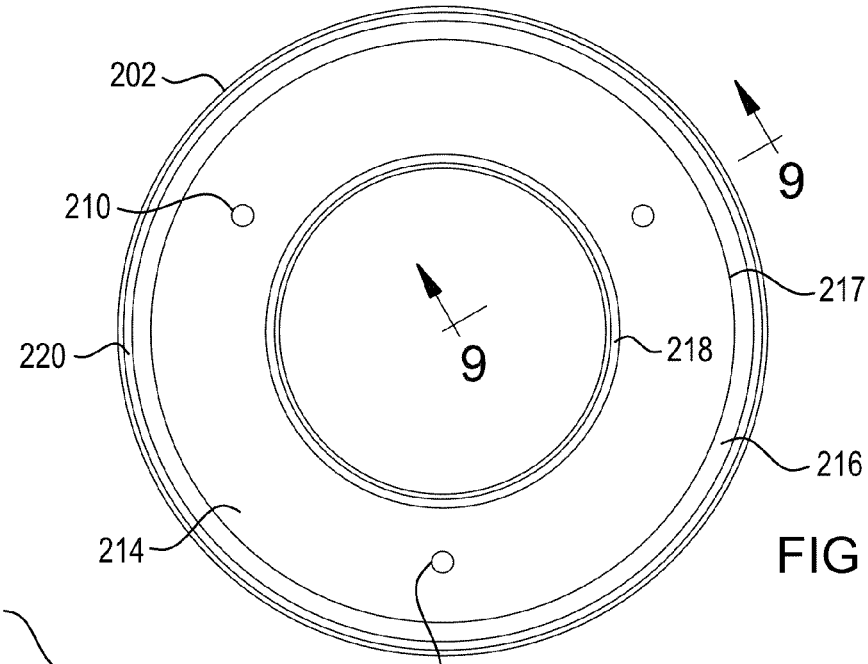
Figure 9:
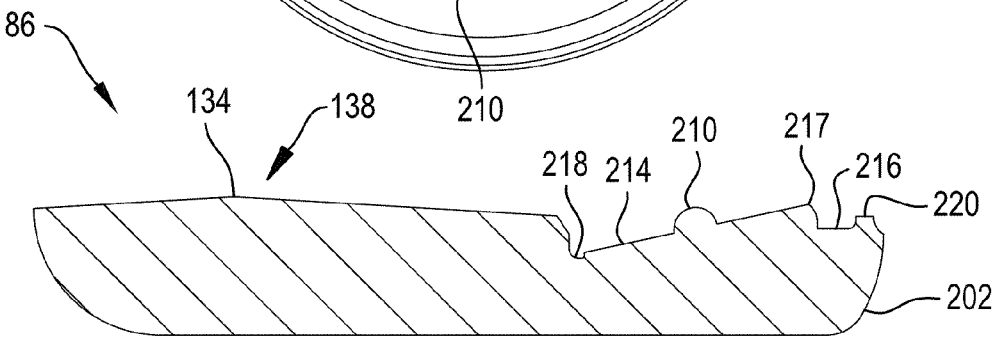
Figure 10:
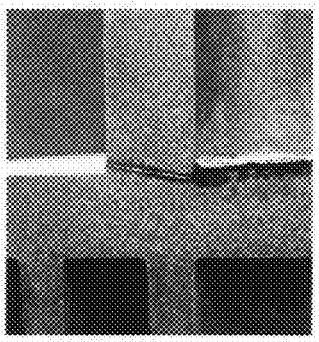
Figure 11:
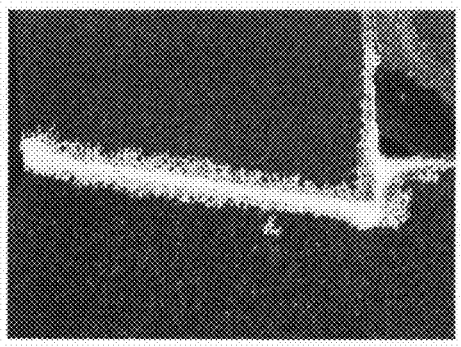
Figure 12A:
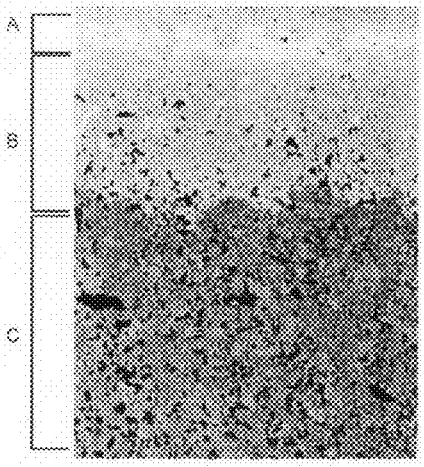
Figure 12B:
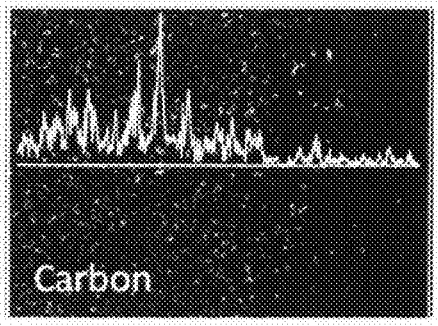
Figure 13A:
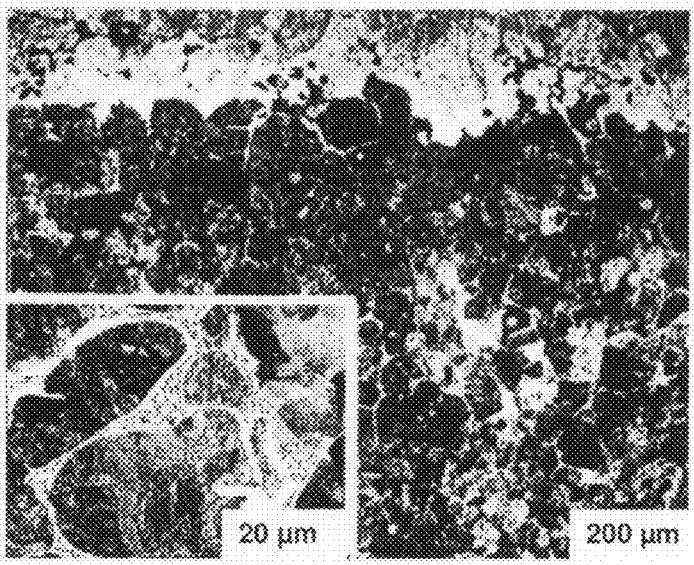
Figure 13B:
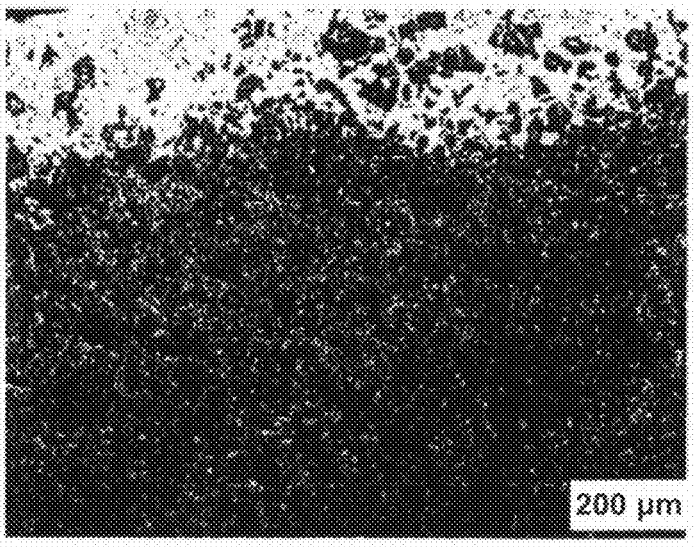

FIG. 3A is an exploded perspective view of an orbiting scroll member subassembly in an assembled form that includes an involute vane component and a baseplate with hub formed in accordance with certain aspects of the present disclosure and FIG. 3B is an exploded perspective views of a non-orbiting scroll member subassembly in an assembled form that includes an involute vane component and a baseplate formed in accordance with certain aspects of the present disclosure;

FIG. 4A is an exploded perspective view of an orbiting scroll member subassembly including an involute vane component and a baseplate having a groove and an attached hub formed in accordance with certain variations of the present disclosure and FIG. 4B is an exploded perspective views of a non-orbiting scroll member subassembly including an involute vane component and a baseplate having a groove formed in accordance with certain variations of the present disclosure;

FIG. 5 is an exploded perspective view of yet another variation according to the principles of the present disclosure having an orbiting scroll member subassembly including an involute vane component and a baseplate;

FIG. 6 is a partial magnified view of the coupling of two powder metal components;

FIG. 7 is a cross-sectional view of a variation of an orbiting scroll member subassembly having a hub and an involute scroll component with a baseplate and integral involute scroll in an assembled form;

FIG. 8 is a plan view of the involute scroll component with a baseplate and integral involute scroll of FIG. 7 prior to coupling of the hub thereto to form the orbiting scroll member;

FIG. 9 is a partial cross-sectional view taken along line 9-9 of FIG. 8 showing a coupling region of a second major surface of a baseplate of the involute scroll portion;

FIGS. 10 and 11 are partially magnified views of a joint interface region of a subassembly of scroll components according to the present teachings;

FIG. 12A is a Scanning Electron Microscope (SEM) micrograph showing a braze affected zone where a braze joint centerline is marked region A (corresponding to white areas), a diffusion zone of a brazing alloy is marked generally at region B (corresponding to lighter gray areas) and a braze affected zone of powder metal region is marked region C (corresponding to dark gray areas);

FIG. 12B depicts the same joint region shown in FIG. 12A, having a carbon dot map by Energy Dispersive Spectroscopy (EDS) overlaid with an elemental profile of carbon, thus showing depletion of carbon in localized areas; and FIGS. 13A and 13B are optical micrographs taken at the periphery of a brazing affected zone (at the joint interface region) transitioning into the bulk of the powder metal component. FIG. 13A shows the formation of eutectic carbides (white regions) induced by sinter-brazing without previously sintering the hub, with a close-up of eutectic carbide in the inset. FIG. 13B shows an absence of such carbides formed in a sinter-brazed joint using a partially and/or fully sintered hub in accordance with the principles set forth in the present disclosure.

DETAILED DESCRIPTION

The following description is merely exemplary in nature and is not intended to limit the present disclosure, application, or uses. The present teachings provide methods of forming scroll compressors via powder metallurgy techniques. As used herein, the term "powder metallurgy" encompasses those techniques that employ powdered (i.e., powder) metal materials (e.g., a plurality of metal particulates) to form a discrete shape of a metal component via sintering, where the powder mass or bulk is heated to a temperature below the melting point of the main constituent of the powder material, thereby facilitating metallurgical bonding and/or fusing of the respective particles. In various aspects, the powder metal material includes a plurality of particulates having an average particle size of greater than or equal to about 10 micrometers (μm), optionally greater than or equal to about 100 μm and in various aspects, generally having an average particle size of less than or equal to about 200 μm. Such particle sizes are merely exemplary in nature and are non-limiting. Powder metallurgy techniques are described in U.S. Pat. No. 6,705,848, the disclosure of which is hereby incorporated herein by reference in its entirety.

Specific examples of suitable powder metallurgy techniques include conventional compression powder metallurgy (P/M). In P/M techniques, a powder metal material is compressed in a die to a "green form" and then is subsequently heated to a sintering temperature in a controlled atmosphere furnace, which depends upon the metal components selected. For example, suitable powder metal materials are described in Metal Powder Industries Federation MPIF Standard 35 (Rev. 2007) for Materials Standards for PM Structural Parts, the relevant portions of which are incorporated herein by reference. All references further cited or referenced herein are expressly incorporated by reference in their respective entireties. In various aspects, the powder metal materials comprise iron and thus are ferrous, such as iron alloys. While sintering temperatures depend on the powder metal material selected and the desired properties in the finished product, ferrous alloys typically require higher sintering temperatures. Suitable sintering temperatures for exemplary ferrous or iron-based alloys are set forth in ASM International Handbook Volume 7, Powder Metal Technologies and Applications, pp. 468-503 (1998). For example, alloys of iron, copper, and carbon have a range of sintering temperatures at greater than or equal to about 1,900° F. (1,037° C.) and less than or equal to about 2,400° F. (1316° C.); for example, suitable ranges include those from greater than or equal to approximately 2,050° F. (1,120° C.) to less than or equal to approximately 2,100° F. (1,150° C.), by way of non-limiting example. In certain aspects, one or more braze joints can be formed during the same heating process which sinters powder metal green components, thus sinter-brazing such components to couple them via a braze joint.

Many methods of forming scroll components containing iron alloy, including powder metallurgy, incorporate carbon-containing ingredients, such as graphite, in the materials. However, the use of such carbon-containing components is potentially problematic. For example, the use of certain carbon-adverse brazing materials to join components can potentially lead to the formation of areas depleted or enriched in carbon. If favorable thermodynamic conditions are met (for example, temperature and carbon content), localized melting occurs and the iron-carbon eutectic known as ledeburite may form beyond the periphery of the braze joint. This eutectic carbide may potentially occur within the grains or at the grain boundary, as a network. In either circumstance, the eutectic carbides can be distinguished from the more benign and desirable secondary carbides found in other metallurgical structures, such as pearlite (which is a mixture of two phases: α-Fe, called ferrite and $Fe_3C$, called cementite). While also dependent upon processing temperatures and other alloying elements present, more benign carbide phases like pearlite, tend to form in regions having relatively lower concentrations of available carbon, as where undesirable eutectic carbide phases typically form in regions that have higher carbon concentrations. Eutectic carbides are generally very hard phases (potentially reaching 70 on the Rockwell C hardness scale) and hence highly abrasive. As a result of their abrasiveness, eutectic carbides can drastically reduce the machinability of any particular ferrous part or component if the machining tool contacts the carbide. The presence of such eutectic carbides can have a detrimental impact on high volume machining, such as what is often employed during scroll compressor manufacturing. As such, minimizing the formation of undesirable eutectic iron carbides near metal surfaces is desirable to enhance machinability of a component, such as a scroll compressor component. Such methods will be described in more detail below.

Furthermore, in accordance with the present teachings, it has been found that detrimental accumulation of carbon can potentially cause issues with brazing alloy penetration into a porous structure of the powder metal and can potentially impact the integrity of any braze joint formed therein. Traditionally, the carbon that resides in the metal part formed with powder metal prior to sintering is in the form of pure unreacted graphite. While not limiting as to the principles by which the present disclosure operates, carbon in this form is believed to react readily and exhibit high mobility at sinter-brazing temperatures. This graphite also serves as a source of carbon for unwanted carbide (e.g., eutectic carbide) formation.

Since eutectic carbides can form near the brazed joint interface regions formed between a first scroll component and a second scroll component, the present teachings are particularly suitable for forming a braze joint. In certain aspects, the present teachings employ a dual sintering process to form an assembly coupled by a braze joint. Such processing methods are particularly useful for parts in a scroll compressor that requires machining, such as the hub component which will be described in more detail below. Thus, components joined together via the inventive methods provide significant improvement in machining. The present methods of forming scroll component parts including a braze joint formed during sintering involves using at least one powder metal material to form at least one component to be joined in the scroll component assembly or subassembly. For example, if a scroll component is partially or fully sintered via a first sintering process in accordance with the present teachings, and later joined by sinter-brazing to a counterpart component via a second sintering process, brazed-induced eutectic carbides are less likely to occur.

In accordance with certain principles of the present disclosure, during the first sintering process, graphite is redistributed via thermal treatment, so that the carbon, along with iron, is converted to a stable phase (such as a pearlite phase comprising ferrite and cementite) after the first heating process for sintering. Similarly, other carbides may form with other alloying element species, such as chromium, molybdenum, vanadium, and/or equivalents thereof. In other aspects, a species such as copper is primarily believed to inhibit carbon mobility in the metal alloy. Thus in certain aspects, most carbon present in a ferrous powder metal material is incorporated into the crystal structure (such as forming pearlite) and thus, in a combined state, is less active than pure graphite. Hence, carbon is less likely to be available (e.g., capable of "breaking free") to form undesirable braze-induced eutectic carbides during subsequent brazing.

Thus, at least one component to be coupled by the sinter braze joint is a ferrous metal having at least 95% by weight of total carbon present in the iron alloy in a form bound to and/or reacted with a species in the ferrous alloy that minimizes carbon migration during brazing. In certain aspects, where the ferrous alloy is selected to be a powder metal material, the present disclosure provides a first sintering step to ensure carbon redistribution that minimizes the presence of reactive carbon by incorporating carbon in a bound or reacted form, for example, in a crystal microstructure, such as a pearlite phase, as will be described in greater detail below. In accordance with certain principles of the present disclosure, whether the scroll component is formed via a powder metal material or other ferrous alloy material, the mobility of carbon is preferably minimized prior to the sintering process where the braze joint is formed, so that carbon is not reactive and does not detrimentally move or migrate with the braze material during sinter-brazing to affect joint quality. Thus, in certain aspects, at least one of the green scroll components to be joined via sinter-brazing is heated in a first sintering process to incorporate greater than or equal to about 95% of the graphite into one or more stable crystal phases. By stable crystal phases, it is meant that the carbon is bound and/or reacted with one or more species in the alloy to have reduced mobility in the material microstructure (e.g., in one or more phases), such that at brazing temperatures, the mobility of carbon is minimized so as to diminish localized accumulation of carbon to potential concentrations that are capable of forming significant eutectic carbides during the heating process near a braze joint that results in a detrimental impact on machinability.

In certain aspects, if porosity of a metal alloy is minimized or absent, negligible amounts of carbon have the opportunity to accumulate in a detrimental manner, since the brazing material only flows along the surface of the part. Thus, in selecting a cast iron, extruded, or wrought part, such as a hub component, it is desirable to select a material having a relatively low carbon content so that negligible amounts of carbides form due to selection of a material having greater than or equal to about 95% by weight of total carbon present in the ferrous iron alloy in a form bound to and/or reacted with a species in the iron alloy that minimizes carbon migration. Although a wrought component is useable, it is likewise contemplated to use a casting, forging, or any other manufacturing process that forms a scroll component having a relatively low carbon content and one that does not result in a matrix having excessive porosity. Thus, in certain alternate aspects, a first scroll component is formed by a metallurgy process selected from the group consisting of: forging, extruding, wrought, casting, and the like. Generally in such a circumstance, a second scroll component is formed via powder metallurgy.

In the context of a hub component, in certain variations, a carbon content of greater than or equal to about 0.4% by weight is desirable to maintain wear resistance. In certain aspects, the upper range of carbon content of the hub formed via another metal forming process (aside from powder metal sintering) can be more flexible than its powder metal counterpart, because of the reduced porosity and accordingly reduced propensity to experience carbide formation-related issues. Thus, in certain aspects, a steel or iron alloy component for a scroll compressor formed by other metal forming processes than powder metallurgy (for example, a cast metal component) optionally has a carbon content of less than or equal to about 4.3% by weight. In certain alternate variations the carbon content is less than or equal to about 4% by weight; optionally less than or equal to about 3.5% by weight, optionally less than or equal to about 3% by weight, optionally less than or equal to about 2.5% by weight and optionally less than or equal to about 1% by weight. In certain alternate variations the carbon content is less than or equal to about 0.9% by weight; optionally less than or equal to about 0.8% by weight, optionally less than or equal to about 0.7% by weight, optionally less than or equal to about 0.6% by weight and optionally less than or equal to about 0.5% by weight.

Thus, according to certain aspects of the present teachings, a method of forming a scroll member is provided that minimizes the formation of braze induced eutectic carbides. Such a method includes mixing a metal component and at least one alloying element to form a powder metal material. In various aspects, the powder metal material includes a species that prevents carbon migration in the powder metal material during the sintering process where sinter-brazing of the braze material occurs. A species includes elements, phases, and alloys of such components. In various aspects, a species that reacts with and/or binds carbon or hinders carbon mobility in a powder metal material includes, but is not restricted to, elements selected from the group consisting of: iron (Fe), copper (Cu), vanadium (V), chromium (Cr), molybdenum (Mo), equivalents, alloys, and combinations thereof. The present teachings are directed to ferrous metals, thus typically copper, vanadium, chromium, molybdenum, and combinations thereof may be added to such ferrous metal materials (along with carbon, typically in a reactive graphite form).

The present teachings of incorporating the aforementioned species (Fe, Cu, V, Cr, Mo and the like) to produce one or more stable phases with carbon may be accomplished by any method of powder production, such as admixing, pre-alloying, diffusion bonding, and the like. The iron, optionally along another species, reacts with and/or binds the reactive graphite in a manner that minimizes carbon migration during flow of brazing material into the braze joint region. The powder metal material may include a plurality of metal components and/or alloying elements or may include other conventional powder metallurgy ingredients including binders, release agents, die-wall or internal lubricants, and the like.

In certain aspects, a base iron powder type is mixed with graphite and copper to form the base iron powder that represents a raw material for hub and/or involute scroll and baseplate. A pressing lubricant is then optionally added to the powder. In this variation, the hub and scroll materials comply with the specification for MPIF FC 0205 (copper nominal 2% by weight and carbon nominal 0.5% by weight) and MPIF FC 0208 (copper nominal 2% by weight and carbon nominal 0.8% by weight), respectively.

The powder metal material is processed to form a green component. In some aspects, this processing generally includes introducing the powder metal material into a die, where the powder material may be compressed. In certain aspects, the first scroll component is processed to a green form by compressing the powder metal material to a void fraction of less than or equal to about 25% by volume of the total volume of the scroll component (in other words, a remaining void space of about 25% of the total volume of the shape), optionally less than or equal to about 20%, and in certain aspects, optionally less than or equal to about 18% of the void volume of the scroll component. Thus, in various aspects the powder metal material (generally including a lubricant system) is placed in a mold of a desired shape and is then compressed with all materials intact. The compression forms a green form, which holds a form and shape corresponding to the die shape.

In accordance with certain principles of the present disclosure, the green structure that is formed, including a metal component and an alloying element is processed via a first sintering process. The first heating process for sintering includes at least partial sintering of the green structure and in certain variations, full sintering of the green structure to form a final sintered structure. "Partial sintering" means that the green scroll component formed from powder metal material is processed via the first sintering process, where it is exposed to a heat source; however, the duration of the exposure is less than is required to achieve substantially complete metallurgical bonding and fusing between the metal particles. In certain aspects, the partial sintering of the green component may be conducted at lower temperatures or for shorter durations than a second final heating process for sintering and brazing. In various aspects, the first heating process is conducted to adequately bind reactive carbon in the powder metal material, so that it is relatively immobile and inert during the initial phases of a subsequent second heating step for sinter-brazing. In other words, the carbon is relatively immobile during the initial brazing at a lower temperature range of the heating process where braze materials flow in a joint region between components to be coupled together. In this manner, the braze joint formed during the second sintering process is of a superior quality, because carbon does not migrate during brazing and sintering. In certain other aspects, the first heating process for sintering is also conducted in order to give strength to the structural component.

As will be described in greater detail below, in certain aspects the methods of the present disclosure expose the scroll component to the first heating process for sintering, where a species that prevents migration of carbon (e.g., an alloying element, such as iron, copper, vanadium, molybdenum, chromium, or combinations thereof) and the ferrous metal component advantageously interact to diminish a total amount of braze-induced carbides. Stated in another way, the first heating process advantageously redistributes carbon via thermal treatment in the metal structure. As noted above, in alternate aspects of the present disclosure, it may be desirable to completely sinter the structural component during the first heating process, and as such, it is contemplated that in certain methods, the green structure is fully sintered and then further processed as described herein in accordance with the present teachings. Such methods of processing the powder metal material are also particularly advantageous for sinter-brazing processes, where several components are joined together to form an assembly for use as a scroll component member.

Optionally, both a first and a second component can be fully sintered in the first heating process and then joined via brazing to additionally reduce the availability of free carbon. However, it should be understood that in alternate aspects, a component, such as a hub, may be formed via an alternate process that adequately reduces the availability of reactive carbon to enhance the integrity of the braze joint formed via sinter-brazing. If one of the components to be joined at the joint interface is formed via another metal forming process other than powder metallurgy (for example, forging or wrought-and-machined parts), the metal material is selected to have a reduced carbon content to minimize undesirable carbide formation. It should be appreciated that the temperatures for carbon redistribution vary based upon the material selected for a first sintering process. In certain aspects, where the powder metal component is treated via a first sintering process, the typical range for carbon redistribution is believed to occur at about 1,560° F. (849° C.) to about 1,740° F. (949° C.) for a Metal Powder Industries Federation FC 0208 powder metal composition (an iron-copper metal having copper ranging from about 1.5 to about 3.9% (nominally 2%) by weight and carbon ranging from 0.6 to 0.9% (nominally 0.8%) by weight.). In accordance with certain aspects of the present disclosure, the first sintering process desirably reaches the appropriate carbon redistribution temperatures for the material being sintered to advantageously redistribute carbon. The heating during the first sintering process step is optionally followed by controlled cooling to form desired stable structure, such as one or more crystal phases, like a pearlite phase, in the sintered component.

Thus, in various aspects, the powder metal material for forming a scroll component includes at least one powder metal component and optionally includes other materials such as alloying elements and lubricants. In a green state, powder metal components are conventionally held together using lubricated metal deformation from pressing for P/M processing. Conventional lubricant systems for P/M formation are well known in the art and include calcium stearate, ethylene bisstrearamide, lithium stearate, stearic acid, zinc stearate, and combinations thereof. Optionally, fixturing during the first sintering process can be used to help prevent part distortion. It has been found that "under-sintering" (but still densifying to the point where density/strength criteria are met) helps to maintain dimensional control. Fixturing may be accomplished by using graphite or ceramic scroll form shapes to minimize distortion.

Figure 1:
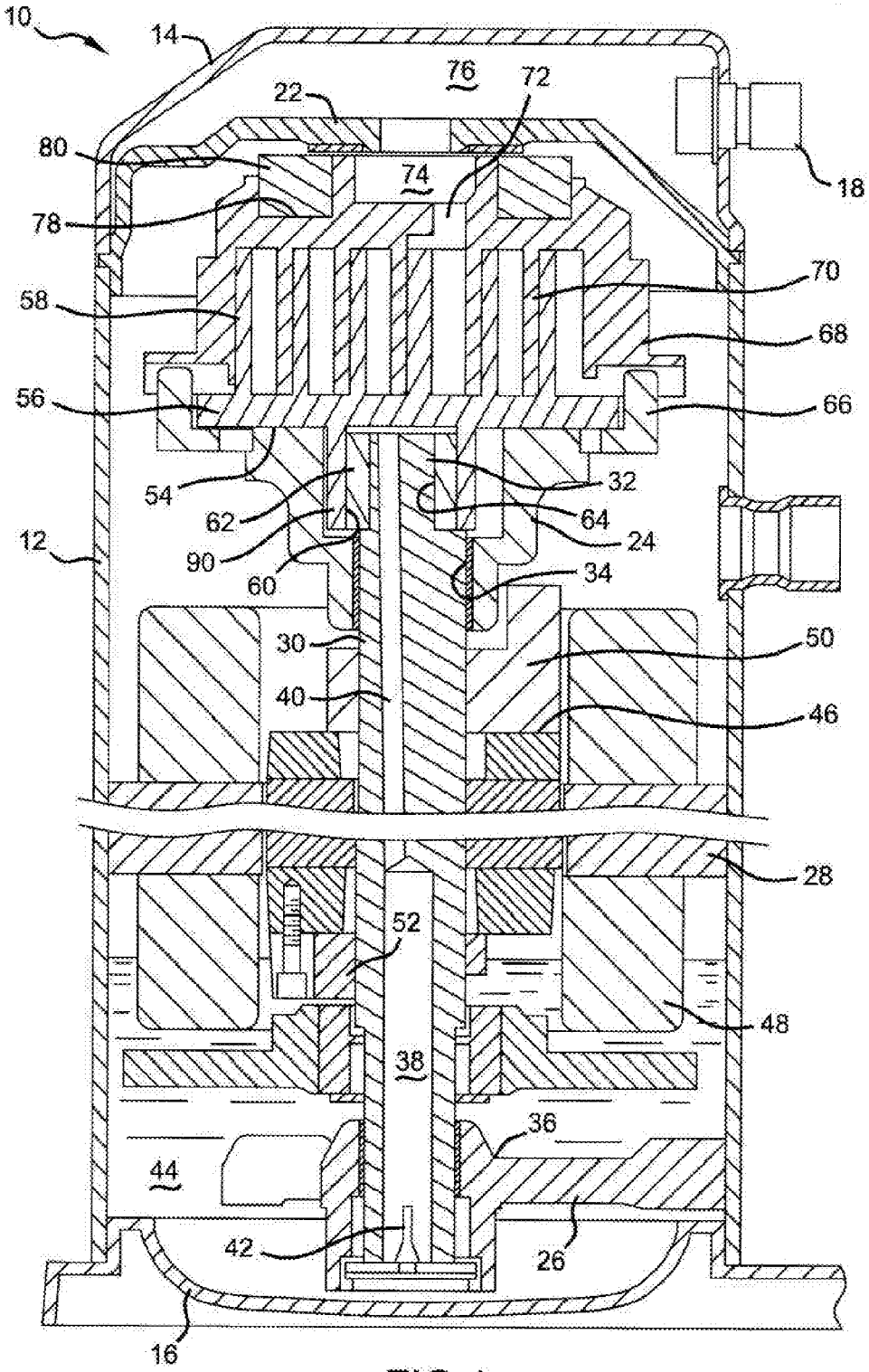
FIG. 1 is a vertical cross-sectional view through the center of a scroll type refrigeration compressor incorporating a scroll component in accordance with the present teachings.

By way of background and referring to the drawings in which like reference numerals designate like or corresponding parts throughout the several views, FIG. 1 illustrates an exemplary scroll compressor 10 that is capable of incorporating a representative scroll component assembly in accordance with the present teachings. The compressor 10 includes a generally cylindrical hermetic shell 12 having a cap 14 welded at the upper end thereof and a base 16 at the lower end optionally having a plurality of mounting feet (not shown) integrally formed therewith. The cap 14 is provided with a refrigerant discharge fitting 18 which may have the usual discharge valve therein (not shown).

Other major elements affixed to the shell include a transversely extending partition 22 welded about its periphery at the same point that the cap 14 is welded to the shell 12, a main bearing housing 24 suitably secured to the shell 12, and a lower bearing housing 26 also having a plurality of radially outwardly extending legs, each of which is also suitably secured to the shell 12. A motor stator 28, which is generally polygonal in cross-section, e.g., 4 to 6 sided, with rounded corners, is press fitted into the shell 12. The flats between the rounded corners on the stator provide passageways between the stator and shell, which facilitate the return flow of lubricant from the top of the shell to the bottom.

A drive shaft or crankshaft 30 having an eccentric crank pin 32 at the upper end thereof is rotatably journaled in a bearing 34 in the main bearing housing 24. A second bearing 36 is disposed in the lower bearing housing 26. The crankshaft 30 has a relatively large diameter concentric bore 38 at the lower end which communicates with a radially outwardly inclined smaller diameter bore 40 extending upwardly therefrom to the top of the crankshaft 30. A stirrer 42 is disposed within the bore 38. The lower portion of the interior shell 12 defines an oil sump 44 filled with lubricating oil to a level slightly lower than the lower end of a rotor 46 but high enough to immerse a significant portion of the lower end turn of the windings 48. The bore 38 acts as a pump to transport lubricating fluid up the crankshaft 30 and into the passageway 40 and ultimately to all of the various portions of the compressor which require lubrication.

The crankshaft 30 is rotatively driven by an electric motor including a stator 28 and windings 48 passing therethrough. The rotor 46 is press fitted on the crankshaft 30 and has upper and lower counterweights 50 and 52, respectively. The upper surface of the main bearing housing 24 is provided with a flat thrust bearing surface 54 on which an orbiting scroll member 56 is disposed having the usual spiral scroll involute vane component 58 on the upper surface thereof. A cylindrical hub member 90 downwardly projects from the lower surface of orbiting scroll member 56 and has a bearing bushing 60 therein. A drive bushing 62 is rotatively disposed in the bearing bushing 60 and has an inner bore 64 in which a crank pin 32 is drivingly disposed.

Crank pin 32 has a flat on one surface which drivingly engages a flat surface formed in a portion of the bore 64 to provide a radially compliant driving arrangement, such as shown in U.S. Pat. No. 4,877,382. An Oldham coupling 66 is provided positioned between the orbiting scroll member 56 and the bearing housing 24 and is keyed to the orbiting scroll member 56 and a non-orbiting scroll member 68 to prevent rotational movement of the orbiting scroll member 56. The Oldham coupling 66 may be of the type disclosed in U.S. Pat. No. 5,320,506.

The non-orbiting scroll member 68 includes a spiral scroll involute vane component 70 positioned in meshing engagement with the spiral scroll involute vane component 58 of the orbiting scroll member 56. The non-orbiting scroll member 68 has a centrally disposed discharge passage 72 that communicates with an upwardly open recess 74 in fluid communication with a discharge muffler chamber 76 defined by the cap 14 and the partition 22. An annular recess 78 may be formed in the non-orbiting scroll member 68 within which a seal assembly 80 is disposed. The recesses 74, 78 and the seal assembly 80 cooperate to define axial pressure biasing chambers to receive pressurized fluid compressed by the scroll involute vanes component 58, 70 so as to exert an axial biasing force on the non-orbiting scroll member 68 to urge the tips of the respective scroll involute vane components 58, 70 into sealing engagement with the opposed end plate surfaces. While details of the seal assembly 80 are not depicted in FIG. 1, non-limiting examples of such seal assemblies 80 may be of the type described in greater detail in U.S. Pat. No. 5,156,539 or floating seals described in U.S. Pat. RE35,216. The non-orbiting scroll member 68 may be designed to be mounted to the bearing housing 24 in a suitable manner such as disclosed in the aforementioned U.S. Pat. No. 4,877,382 or U.S. Pat. No. 5,102,316.

Figure 2:
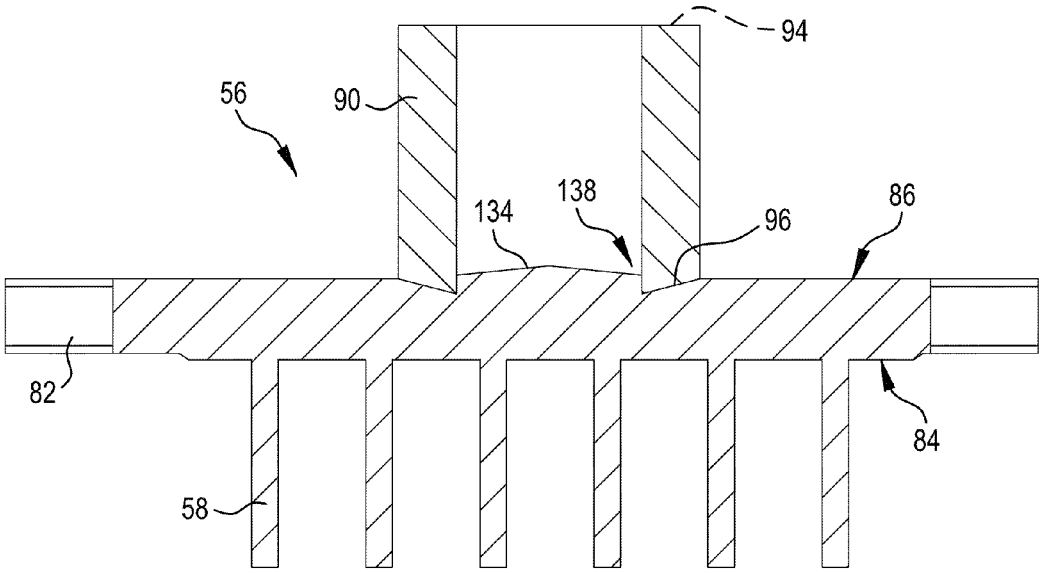
FIG. 2 is a cross-sectional view of an orbiting scroll member subassembly in an assembled form.

FIG. 2 is a cross-sectional view of an assembled orbiting scroll member as illustrated in FIG. 1. As shown, the orbiting scroll member 56 may include a generally circular baseplate 82 having first and second generally planar opposing major surfaces represented by reference numbers 84 and 86, respectively. The first major surface 84 may be coupled to the spiral scroll involute vane component 58. An opposing second major surface 86 may include a coupling feature 138 such as an annular raised shoulder (shown in FIGS. 2 and 9 as 134), or a raised cylindrical pad (not shown), extending a distance generally perpendicular to the baseplate 82. In certain aspects, it is envisioned a thickness ratio of the body of the baseplate 82 to the raised shoulder protruding pilot 134 is about 5:1 to 10:1. In some aspects, the second major surface 86 has an elevated dam 220 (shown in FIGS. 8 and 9). In certain aspects, the scroll involute vane component 58 and the baseplate 82 may be one monolithic component.

Where multiple subcomponent assemblies are formed by powder metallurgy or one or more components are formed from a different metal formation technique and at least one is formed by powder metallurgy, a final sintering step may be desirable to completely remove the binder system and to fully sinter the structure of each powder metallurgy component, as is well known in the art. Furthermore, in certain subassemblies, a brazing material may be desirable to place in one or more joint interface regions formed between several components as will be described in more detail below. "Sinter-brazing" is a process where two or more pieces of an assembly are joined by melting a brazing material at respective surfaces of a joint, where the sintering and brazing are conducted within the same furnace. Components joined by sinter-brazing processes form strong joints having high structural integrity which permit complexity in the shapes of powder metal subassemblies that are formed.

In certain variations, such as that shown in FIG. 3A, the involute vane component 58 is attached to a support base 112. The involute vane component 58 can be formed integrally with support base 112 (e.g., as a powder metal component) or coupled in accordance with any of the joining techniques discussed in the present disclosure, for example. The baseplate 82 has hub 90 attached thereto (either formed integrally or joined together via a joint, for example as discussed below) and first major surface 84 includes a contact surface 114 that confronts support base 112. Thus, support base 112 can be joined to contact surface 114 of baseplate 82 via the various techniques described in the present disclosure.

FIG. 3B shows a similar coupling configuration for a non-orbiting scroll member 68. Involute vane component 70 is attached to support base 100. The involute vane component 70 can be formed integrally with support base 102 (e.g., as a powder metal component) or coupled in accordance with any of the joining techniques discussed in the present disclosure, for example. A baseplate 102 defines a contact surface 104 that confronts support base 102. Support base 102 can be joined to contact surface 104 of baseplate 102 via the various techniques described in the present disclosure.

In yet other variations like those shown in FIGS. 4A-4B, a groove can be employed to align and couple the parts to be joined. For example, in FIG. 4A, involute vane component 58 can be aligned with a groove 98 formed in first major surface 84 of baseplate 82 of orbiting scroll member 56. Baseplate groove 98 in the baseplate 82 can be used to register and align the involute vane component 58 onto the first major surface 84 of baseplate 82. The baseplate grooves 98 can be preformed (for example, via molding) or machined into the first major surface 84, prior to joining of the involute vane component 58 to the baseplate 82.

Baseplate groove 82 also enhances the fatigue strength of the orbiting scroll member 56 at the interface between involute vane component 58 and baseplate 82. Such a baseplate groove 98 can support the bending moment and help minimize the local strain in a hardened zone near the joint and thus lessen potential of fatigue failure at the joint. While not shown, a brazing material may be disposed in the groove 98 to facilitate coupling of the baseplate 82 to involute vane component 58, in accordance with the principles set forth herein.

In certain aspects, baseplate groove 98 can potentially result in the disadvantage of shunting (shorting at the sides of the involute vane component 58 at the wall of groove 98). Thus, in certain aspects, a high impedance resistive coating (not shown) can optionally be formed on involute vane component 58 or in the baseplate groove 98 to minimize any potential shunting effects.

Similarly, FIG. 4B shows non-orbiting scroll member 68, where baseplate 102 defines a contact surface 104 that includes a groove 110, similar to that described above in the context of FIG. 4A. Thus, in much the same manner, involute vane component 70 can be aligned with and attached to baseplate 102 via groove 110.

As shown in the exemplary orbiting scroll member 56 of FIG. 5, it is also possible to align and contact the involute vane component 58 with a contact surface 120 of baseplate 82 via any of the techniques described herein without the use of the baseplate groove (e.g., 98). This negates the need for preforming or milling any baseplate grooves, which may increase expense during fabrication. While not shown, such principles are equally applicable to joining of the non-orbiting scroll member 68 with involute vane component 70.

Optionally, the scroll involute vane component 58 and baseplate 82 of orbiting scroll member 56 may include multiple components joined together along a taper joint, such as by using brazing materials to join the scroll involute vane component 58 to baseplate 82. A particularly suitable taper joint for joining a first scroll component to a second scroll component may range at angles from 0 to less than or equal to about 20 degrees; optionally from greater than or equal to 5 degrees to less than or equal to 15 degrees. Any of the respective components described above may also be produced from cast, forged, or wrought materials (as will be discussed in further detail below). Further, while in preferred variations, such components are joined via the sinter-brazing techniques described in the present disclosure, in alternate aspects, such components may be joined via conventional coupling techniques known to those of skill in the art.

A cylindrical hub member 90 may include first and second opposing edges 92, 94. The hub member 90 may be formed using wrought material with standard casting techniques or other forming processes, including powder metal techniques. The hub member 90 is optionally mechanically fastened to the baseplate 82. For example, the hub member 90 may be brazed to the raised shoulder 88 or a raised pad, at a joint 96 using typical brazing methods known to those skilled in the art. In certain aspects, the joint 96 may be of the type described in U.S. Pat. No. 5,156,539. The joint 96 may also be brazed using methods suitable for use with powder metal materials. In certain aspects, green components (formed of the first material powder metal) can be assembled and brazed together while the green structure is sintered. A solid hub member 90 may be fastened utilizing materials that harden during the sintering process.

FIG. 6 represents a method of forming an exemplary sinter-brazed joint, here between a cylindrical hub member 90 and a baseplate 82 of the orbiting scroll member 56. Baseplate 82 has a first major surface 84 coupled to the involute scroll vane component 58 and second opposing major surface 86 having a protruding coupling member or feature 138. The cylindrical hub member 90 is processed via a first sintering process for at least partial sintering (i.e., either partially or fully sintered) and is aligned with the coupling feature 138 of the second major surface 86. The brazing material, in a form such as a brazing paste, or brazing pellets (spherical or other similar shapes), or a brazing ring is provided in a joint interface region, adjacent to at least a portion of one or both of a protruding pilot 134 and the hub member 90. The protruding pilot 134 may include a cone shape. In providing a brazing material, brazing pellets are optionally placed on the protruding pilot 134 and then allowed to travel to an inside diameter of the hub member 90 prior to the brazing process. The sintered hub member 90 (which is either partially or fully sintered) is then sinter-brazed to the baseplate 82, to form the scroll member subassembly 56. After additional sinter-brazing takes place to form the orbiting scroll member 56, any desired machining can be performed.

In accordance with certain aspects of the present disclosure, prior to coupling the hub member 90 to the baseplate 82 in a second sintering process, the hub member 90 is processed via a first sintering process. In certain aspects, the first sintering process is conducted for about 10 to 30 minutes in the hottest furnace zone at temperatures of about 1,900° F. (1,037° C.) and less than about 2,400° F. (1316° C.); optionally at about 2,050° F. (1,120° C.) to about 2,100° F. (1,150° C.). As will be appreciated by those of skill in the art, such temperatures may be dependent upon the materials selected and here pertain to ferrous carbon copper powder metal alloy materials MPIF FC 0208 and MPIF FC 0205. At this stage, the iron particles are believed to begin to join, forming necks therebetween. In certain aspects, about 95% of the free carbon is either burned off/volatilized from the structure or incorporated into the crystalline structures of the metal component (e.g., iron particles) phase. In this regard, the hub member 90 may be previously partially or fully sintered to form a pearlite phase or other crystalline structures within the powder metal of the metal component. In this manner, the amount of carbon available for carbide formation during the sinter-brazing of the two components is beneficially diminished.

In certain aspects, the alloying element, in particular the carbon as the alloying element, is substantially incorporated into a crystal structure of a phase including the metal component. By "substantially incorporated" it is meant that greater than or equal to about 95% by weight of the (e.g., carbon) alloying element that remains in the partially sintered structure is incorporated in the crystal structure, optionally greater than or equal to about 96% by weight, optionally greater than or equal to about 97% by weight, optionally greater than or equal to about 98% by weight, and in certain aspects, optionally greater than about 99% by weight of the alloying element is incorporated into the crystal structure of the metal component(s), which in certain aspects, include at least one of the aforementioned species that prevent carbon migration during the second sintering process.

FIGS. 10 and 11 are partial magnified views of the coupling via a braze joint of two metal components each formed via powder metallurgy. Prior to forming the green part, a first material mixture is formed by mixing a powder metal containing iron and an alloying element containing carbon, copper, or combinations thereof. This mixture in powder form is then compressed to form a green structure, for example, the powder material is compressed to a void volume fraction of less than about 18%. The green structure is subjected to a first sintering heating process described above. The green structure may be a scroll involute component, a baseplate for a scroll involute component, a hub, or any other portion of a component of the scroll compressor.

As noted above, in alternate variations, the structure may not be formed via powder metallurgy, but rather by an alternate metal manufacturing process, but is selected such that reactive carbon content is relatively low in accordance with the present disclosure and is processed in lieu of the green structure, as described herein.

In one variation, a brazing material is provided between a previously sintered or partially sintered component (conducted during a first heating step), such as a hub, and a second component, such as a baseplate with an integral involute scroll form, comprising a green powder metal material. In this regard, the fully sintered or partially sintered powder metal component (e.g., hub) is brazed to a second powder metal component (e.g., scroll involute), which is further sintered during this second heating process. In certain aspects, during the second heating process at brazing temperatures, the brazing material melts and flows onto the metal surfaces via capillary action between the first and second components (e.g., hub and baseplate), thus forming the centerline and also penetrates into the powder metal structure and quickly fills it with liquid brazing alloy. Penetration occurs because of the porous nature of metal parts formed by powder metallurgy, with the amount of penetration being related to the relative porosity expressed by void volume fraction.

FIG. 7 shows one variation of coupling of a hub member 90 to a baseplate 202 having an integral involute component attached in accordance with the principles of the present disclosure. FIG. 8 shows a top view of the region of the baseplate 202 where the hub member 90 is attached. The hub member 90 is sinter-brazed and forms a braze joint 204 with baseplate 202. FIG. 9 is a partial cross sectional view of the region of baseplate 202 where hub member 90 is joined via braze joint 204. As can be seen, a plurality of protrusions 210 are depicted in FIGS. 8 and 9. These protrusions are slightly raised portions upon which the lower surface 212 of the hub member 90 will rest. These protrusions provide a small gap between lower surface 212 of hub member 90 and contact surface 214 (a major surface) of baseplate 202. First groove 216 is formed in the outer peripheral area of baseplate 202 which provides an overflow volume for any brazing material that might migrate from the region of the braze joint 204. Further, an elevated braze dam 220 can be formed radially outward from the first groove 216 that further prevents the brazing material from leaving the braze joint/coupling region.

A second groove 218 is formed radially inward from first groove 216 which provides a collecting area for any excess brazing material and also provides extra volume to account for any burring formed on the hub member 90 during formation processes, in other words a burr trap. As can be seen in the areas outside of protrusions 210, the contact surface 214 of baseplate 202 will provide a gap between the lower surface 212 of hub member 90 and the baseplate contact surface 214. The height and number of the protrusions may vary based on the brazing material selected, because certain brazing materials have lower viscosities at melting temperature as where other brazing materials have higher viscosities. The viscosity at melting temperatures relates to the degree of wetting and capillary action to sufficiently coat respective contact surfaces. Thus the gap between contact surface 214 and lower surface 212 is predetermined based upon the properties of the selected brazing material, as recognized by those of skill in the art.

For example suitable gap dimensions for brazing materials including alloys of copper, nickel, boron, manganese, iron, and silicon, which are particularly suitable for forming a brazed joint in accordance with the present teachings have a dimension of about 0.002 inches (about 51 micrometers or microns) to about 0.005 inches (about 127 micrometers). In certain aspects the dimension of the gap formed between the contact surface (214) of the baseplate (202) and contact surface (212) of hub (90) is about 0.003 inches (about 76 microns) to about 0.004 inches (about 102 microns).

In various aspects, a second heating step includes heating the subassembly of scroll components having brazing material disposed therein from a starting temperature through a brazing temperature range and then to a higher sintering temperature range. The sinter-brazing heating process provides a subsequent increase in temperature to reach the sintering plateau (hot zone of the furnace) during the sintering process. Thus, temperature is raised and held at this sintering level for a predetermined period of time and later cooled, unlike in typical/dedicated brazing, where the part may be cooled shortly after reaching the brazing temperature. For example, the first and/or second heating process steps can optionally include heating for a duration of 3 or more hours.

Thus, in certain variations, during the second heating process, heating of the scroll involute components from ambient temperature (as a starting point) occurs to and through a brazing temperature range and then up to sintering temperatures. In certain aspects, the sintering temperature plateau occurs for about 30 minutes of heating. For example, where the powder metal materials are selected to be iron/carbon/copper alloy MPIF FC 0205 for the hub and iron/copper/carbon alloy MPIF FC 0208 for the baseplate and involute, heating from starting temperature to about 2,100° F. (1,150° C.) occurs for about 30 minutes longer, followed by a slow cooling step. Notably, while the brazing temperature ranges depend upon the brazing materials selected, brazing temperatures that liquefy and distribute brazing material in the coupling region are substantially lower than sintering temperatures. Exemplary and non-limiting brazing temperatures can occur at temperature ranges of about 900° F. (about 482° C.)

to about 1,200° F. (about 649° C.), while sintering temperatures may be in the range of about 2100° F. (about 1,150° C.).

In certain aspects, during the sinter-brazing process occurring at the high temperature regime of the sintering process, redistribution of the alloying elements by diffusion is permitted to occur due to a longer duration at sintering temperatures. Thus, in certain aspects, where the brazing material comprises copper (Cu), the prevalent brazing material in the brazed joint centerline is a Cu-based solid solution associated with other intermetallic phases. Extended from the centerline, the initially unalloyed high carbon steel metallic matrix is converted into a lower carbon content steel, which is strongly alloyed with nickel (Ni) and manganese (Mn), due to the braze alloy for example. During the redistribution process, carbon is transported and accumulated beyond the periphery of the aforementioned brazing affected area. This process is believed to occur because the brazing alloy is selected so that it does not have an affinity for carbon (stated in another way, the particular brazing filler metal has a low solubility for carbon).

Suitable brazing materials comprise copper, nickel, boron, manganese, iron, silicon, and combinations thereof. For example, one particularly suitable braze filler powder comprises a pre-alloyed based powder comprising nickel at about 40 to about 44 wt. %, copper at about 38 to about 42 wt. %, boron at about 1.3 to about 1.7 wt. %, manganese at about 14 to about 17 wt. %, and silicon at about 1.6 to about 2 wt. %. This pre-alloyed base powder can then be combined with conventional additives, such as iron, flux materials like boric acid, borax, and a surfactant, for example present at about 3% nominal, and/or lubricant(s), for example, at about 0.53% nominal. In certain variations, such a brazing material liquefies and then forms various intermetallic components having higher melting temperatures which desirably solidify beyond brazing temperatures up to the sintering temperature range, so that the braze joint is substantially formed by the braze material through the higher temperature ranges for sintering of the powder metal materials.

A brazing affected zone (at the joint interface region between a portion of the hub and a portion of the baseplate) for a comparative braze joint formed between a green hub and a green baseplate during sinter-brazing is shown in FIGS. 12A and 12B, where the carbon supplied by the free graphite used to alloy the iron powder particles is rejected in front of the advancing diffusion zone and thus accumulates at the leading edge of the diffusion front. In FIG. 12A, region A is a very light grey color showing the approximate centerline of the braze joint, region B shows minimal amounts of carbon in the brazing affected zone and in region C, the dark gray region indicates high carbon content (as can be seen in the corresponding elemental carbon analysis overlaid on the carbon dot map of the same region in FIG. 12B). Thus, free carbon has been carried to the front of the advancing diffusion zone in the braze joint area and accumulated in region C. In the case of a carbon steel powder metal alloy, an additional source of carbon is the powder metal itself (for example steel).

During the solidification of the liquid braze and subsequent cooling of the metal component formed during sinter-brazing, the carbon in a carbon-rich region is believed to combine with iron to form eutectic iron carbides, either within the grain or, mostly, as a network at the grain boundary. Thus, where localized carbon content is relatively high, for example at the advancing front (top of the region C in FIGS. 12A/12B), the potential exists for undesirable eutectic carbides to form. By way of example, eutectic carbon and iron carbides can form where carbon is locally present at concentrations of greater than about 6.67 wt. %. An example of such carbides is shown in FIG. 13A, a comparative example of prior art sinter-brazing without a first heating process for at least partial sintering of one or more of the parts forming the joint. Depending on location and on the process parameters, affected zones as deep as 3 mm have been observed. Since the eutectic temperature at which the iron-carbon eutectic carbides form occurs at the sintering temperatures supplied by the furnace environment of the second heating for sinter-braze, the principles of the present disclosure provide a manner in which to minimize localized accumulation of carbon to diminish the likelihood of forming eutectic carbides, particularly at the periphery of the braze joint region (top of the region C in FIGS. 12A/12B).

Optionally, the powder metal material for the scroll component (e.g., steel alloy for a hub) can be selected to have relatively low or reduced carbon content. As carbide formation draws its carbon from the graphite in the original metal (e.g., steel powder), the starting amount of graphite in the powder metal relates to a final or terminal amount of carbide that can ultimately form. As noted above, the local concentration of carbon thermodynamically necessary to form carbides is approximately 6.67 wt. %. Since the starting carbon is in the form of graphite (100% carbon), the likelihood of its accumulation and utilization to form these carbides without previously partially or fully sintering can be fairly high. Thus, in accordance with the present teachings, the initial amount of carbon in powder metal materials is selected to be relatively low.

As a result, in certain variations, reducing the carbon content in the powder metal material from a nominal amount of about 0.8 wt. % to a nominal amount of 0.5 wt. % (about 0.4 wt. % to about 0.6 wt. %), substantially reduces the amount of undesirable carbide formation. Optionally, the carbon percentage can be reduced to below about 0.4 wt. % in certain thin outward areas of the metal part formed with powder metal. Specifically, the carbon level in the scroll involute and baseplate can remain at about 0.8 wt. % nominal. This condition maintains adequate levels of pearlite to prevent premature wear of the involute vanes and baseplate (which experience high wear conditions), while desirably minimizing presence of excess carbon.

Further, the present disclosure provides methods of selecting and treating such materials to inhibit, bind, and/or diminish carbon mobility during the sintering and brazing process. In one variation, the involute scroll, including vanes and/or baseplate can be formed of a carbon steel material (Metal Powder Industries Federation "MPIF" FC 0208): an iron, copper, and carbon alloy having nominally 2% by weight copper and 0.8% by weight carbon. As an example, lower carbon powder metal (MPIF FC 0205) is suitable for use as the powder metal hub. At least one of the components (for example, either the involute form and/or the hub) to be joined is partially sintered to form one or more crystal structures, such as a pearlite phase, in the first sintering process step. Optionally, the components can be formed using iron alloys with carbon content at about 0.4 wt. % to about 0.6 wt. %; copper content at about 1.5 wt. % to about 3.9 wt. %; where the total other elements are about 2.0 wt. % maximum, with the balance being iron. As noted above, in certain aspects, hub and scroll involute/baseplate powder metal materials may comply with the specification for MPIF FC 0205 (copper nominal 2% by weight and carbon nominal 0.5% by weight) and MPIF FC 0208 (copper nominal 2% by weight and carbon nominal 0.8% by weight), respectively.

The brazing material is obtained by mixing a first metallic powder containing about 38 to about 42 wt. % Cu, about 14 to about 17 wt. % Mn, and about 40 to about 44 wt. % Ni, and about 1.6 to about 2 wt. % Si, and about 1.3 to about 1.7 wt. % B with a second metallic powder containing iron in an amount of about 3 to about 7% by weight of the first metallic powder. Lubricant and flux are optionally added to the brazing material for pressing and wetting purposes, respectively.

In FIG. 13B the hub has been subjected to the first heating sintering process. The assembly hub/baseplate is then subjected to the second heating process to sinter-braze the assembly. The first heating process for sintering the hub achieves a partial sintering temperature at about 2,100° F. (1,150° C.) having a holding time of about 30 minutes in an endothermic atmosphere (e.g., methane or natural gas in the presence of a heated catalyst), then control-cooled to form stable carbon compound such as a pearlite phase. Hydrogen, nitrogen, or other neutral atmospheres are also a suitable. Afterward, the braze material is disposed in a joint between the hub and baseplate then the assembly of hub, baseplate, and brazing material is subjected to a second heating process for brazing and sintering. In this example, the second heating process achieves a sinter-brazing temperature in the hot zone of about 2,100° F. (1,150° C.). The assembly is held for about 30 minutes in an endothermic gas atmosphere. For comparison in FIG. 13A, neither the hub, nor the baseplate has been subjected to the first heating process for sintering (in other words, both components are green and neither has been previously sintered prior to the sinter-brazing step).

Table 1 shows a final sintered powder metal scroll component part composition, which includes vanes and baseplate. Table 1 reflects the composition prior to polymer impregnation and excludes any braze material and braze affected-zone near the joint. While MPIF Standard FC 0208 (0.8 wt. Carbon) may be specified; in certain aspects the alloy materials meet all the requirements set forth herein.

TABLE 1

| | Weight Percent |
|---|---|
| Total Carbon | 0.7-0.9; optionally 0.75-0.85 |
| Copper | 1.5-3.9 |
| Total Other Elements | Maximum 2.0 |
| Iron | Balance |

In certain variations, the final sintered powder metal hub has a composition set forth in Table 2, again prior to polymer impregnation and excluding any braze material or composition near a braze affected zone. MPIF Standard FC 0205 (0.5 wt. % Carbon) may be specified, however, in certain aspects the hub material can meet the requirements set forth herein.

TABLE 2

| | Weight Percent |
|---|---|
| Total Carbon | 0.4-0.6; optionally 0.45-0.55 |
| Copper | 1.5-3.9 |
| Total Other Elements | Maximum 2.0 |
| Iron | Balance |

In certain variations, the composition of a suitable braze filler powder is as follows in Table 3.

TABLE 3

| | Weight Percent for Braze Powder |
|---|---|
| Nickel* | 40-44 |
| Copper* | 38-42 |
| Boron* | 1.3-1.7 |

TABLE 3-continued

| | Weight Percent for Braze Powder |
|---|---|
| Manganese* | 14-17 |
| Silicon* | 1.6-2.0 |
| Lubricant | 0.53 nominal |
| Flux Content | 3% nominal (typically contains Boric Acid, Borax, and a Surfactant) |

*Chemical composition of pre-alloyed brazing powder excluding lubricant, flux and iron. Add 3-7% (5% preferred) Iron by weight to the above for the final brazing material (which changes weight percentages of the original pre-alloyed braze powder).

FIG. 13B represents a sinter-brazed joint interface according to the teachings herein. As compared with the micrograph in FIG. 13A, the formation of carbides is significantly restricted by the use of a partially or fully sintered metal component formed with powder metal in accordance with the principles of the present disclosure (thus having carbon in a form bound to and/or reacted with at least one species in the iron alloy that minimizes carbon migration to diminish carbon mobility at brazing temperatures). In comparison, FIG. 13A shows a sinter-brazed joint for which a green metal hub and a green baseplate are formed with powder metal, but have not been previously sintered in any manner.

Thus, FIGS. 13A and 13B provide comparative results of the hub having previous sintering processing in accordance with the present disclosure (FIG. 13B) versus conventional processing via powder metallurgy (FIG. 13A). As can be observed from FIG. 13A, the conventional powder metallurgy process has an undesirably extensive carbide network formed throughout. In contrast, the powder metal material having an iron-containing metal powder and alloying elements processed in accordance with the present disclosure (comprising carbon and copper), demonstrates a dearth of eutectic carbide formation, attributable to the presence of one or more species that minimize carbon mobility by binding and/or reacting with carbon during the partial sintering step, which incorporates the free-carbon graphite into one or more phase crystal structures (e.g., pearlite phase which is ferrite and cementite formed by iron and carbon) during the partial sintering phase. As such, the sinter-brazing processes according to the present teachings provide components having improved machinability by reducing migration of alloying ingredients, such as carbon, while permitting joining of several ferrous components into a subassembly by a strong and integral bond, sufficient to withstand service conditions for scroll compressors.

Furthermore, the methods and principles of the present disclosure can be broadly applied to joining of components to form assemblies or other complex parts and shapes via sinter-brazing. For example, where at least one of the components is a ferrous powder metal material, the powder metal component is treated via a first heating step to inhibit, bind, and/or diminish carbon mobility during the sintering and brazing process. Preferably, after such an initial heating process, an iron alloy of the powder metal component(s) has at least 95% by weight of total carbon present in the iron alloy in a form bound to and/or reacted with at least one species in the iron alloy that minimizes carbon migration. If one of the components to be joined is not formed via powder metallurgy (e.g., cast, wrought, forged), it is preferable to select a ferrous component having a relatively low carbon content (as discussed above). After the initial heating process, a brazing material may be disposed in a joint interface region formed between at least a portion of the parts to be joined. Then, the assembly is heated in a second heating process to sinter-braze the first and second scroll components having brazing material therebetween to couple them together to form the desired assembly.

The description is merely exemplary in nature and, thus, variations are intended to be within the scope of the teachings. For example, it is envisioned that the methods described herein can be applied to the coupling of other iron based powder metal components using simultaneous sinter-brazing coupling techniques. Further, the concept can be broadly used to prevent the undesirable migration of other alloying elements during sinter-brazing.

What is claimed is:

1. A method of forming a scroll member comprising:

heating a first scroll component comprising a powder metal material comprising an iron alloy in a furnace having a temperature of greater than or equal to about 1,900° F. (1,037° C.) for at least partial sintering during a first heating process, wherein said first scroll component is a hub and said iron alloy comprises carbon at greater than or equal to about 0.4% to less than or equal to about 0.6% by weight;

cooling said first scroll component, wherein after said first heating process and said cooling said iron alloy has greater than or equal to about 95% by weight of a total amount of carbon remaining in said iron alloy in a form bound to and/or reacted with at least one species in said iron alloy that minimizes carbon migration;

disposing a brazing material in a joint interface region formed between a portion of said first scroll component and a portion of a second scroll component comprising a baseplate and an involute, wherein said second scroll component comprises a second distinct iron alloy comprising carbon at greater than or equal to about 0.7% to less than or equal to about 0.9% by weight; and heating to sinter-braze said first and second scroll components having said brazing material therebetween in a furnace having a temperature of greater than or equal to about 1,900° F. (1,037° C.) in a second heating process to form the scroll member having a braze joint coupling said portion of said first scroll component to said portion of said second scroll component.

2. The method of claim 1, wherein prior to said first heating process, said first scroll component is processed to a green form by compressing said powder metal material to a void fraction of less than or equal to about 18% by volume of a total volume of the first scroll component.

3. The method of claim 1, wherein said at least one species that minimizes carbon migration in said iron alloy during said second heating process is selected from the group consisting of: iron, copper, vanadium, chromium, molybdenum, and combinations thereof.

4. The method of claim 3, wherein said first heating process and said cooling is controlled so as to form one or more crystal structures in said iron alloy that incorporate greater than or equal to about 95% by weight of said carbon.

5. The method of claim 4, wherein at least one of said species that minimizes carbon migration comprises iron and one or more of said crystal structures includes a pearlite phase, wherein said first heating process is conducted until greater than or equal to about 99% by weight of said carbon is incorporated into said pearlite phase in said first scroll component.

6. The method of claim 1, wherein said first scroll component comprises said iron alloy having greater than or equal to about 95% by weight of total carbon remaining in said iron alloy in a form bound to and/or reacted with at least one of said species in said iron alloy to minimize carbon migration, wherein said first scroll component is formed by a metallurgy process selected from the group consisting of: forging, extruding, wrought, casting, and equivalents thereof.

7. The method of claim 1, wherein said brazing material comprises an element selected from a group consisting of: copper, nickel, boron, manganese, silicon, iron, and combinations thereof.

8. The method of claim 1, wherein said first scroll component and said second scroll component are each formed from powder metal material and each are at least partially sintered via said first heating process prior to said disposing and heating to sinter-braze.

9. The method of claim 1, wherein a portion of said hub and a portion of said baseplate are joined after said heating to sinter-braze at said joint interface region to form said braze joint.

10. A method of forming a scroll member comprising:

heating a first scroll component comprising a powder metal material comprising an iron alloy for partial sintering during a first heating process, wherein said first scroll component is a hub and said iron alloy comprises carbon at greater than or equal to about 0.4% to less than or equal to about 0.6% by weight;

cooling said first scroll component, wherein after the first heating process and said cooling said iron alloy has greater than or equal to about 95% by weight of a total amount of carbon present in said iron alloy in a form bound to and/or reacted with at least one species in said iron alloy that minimizes carbon migration;

disposing a brazing material between a portion of said first scroll component and a second scroll component comprising a baseplate and an involute, wherein said second scroll component comprises a second distinct iron alloy comprising carbon at greater than or equal to about 0.7% to less than or equal to about 0.9% by weight; and heating to sinter-braze said first and second scroll components having said brazing material therebetween via a second heating process in a furnace having a temperature of greater than or equal to about 1,900° F. (1,037° C.) to form the scroll member having a braze joint coupling a portion of said first scroll component to a portion of said second scroll component.

11. The method of claim 10, wherein prior to said first heating process, said first scroll component is processed to a green form by compressing said powder metal material to a void fraction of less than or equal to about 18% by volume of a total volume of the first scroll component.

12. The method of claim 10, wherein after said first heating process and said cooling, said first scroll component has greater than or equal to about 97% by weight of total carbon present in said form bound to and/or reacted with said at least one species that minimizes carbon migration during said second heating process.

13. The method of claim 12, wherein after said first heating process and said cooling, said first scroll component has greater than or equal to about 99% by weight of total carbon present in said form bound to and/or reacted with said at least one species that minimizes carbon migration during said second heating process.

14. The method of claim 12, wherein said at least one species that minimizes carbon migration in said powder metal material during said second heating process is selected from the group consisting of: iron, copper, vanadium, chromium, molybdenum, and combinations thereof.

15. The method of claim 12, wherein during said first heating process at least a portion of said powder metal material forms a pearlite phase, and said first heating process is conducted until greater than or equal to about 99% of said carbon is incorporated into said pearlite phase in said first scroll component.

16. The method of claim 10, wherein said first scroll component and said second scroll component are both formed from powder metal material and both of said first and second scroll components are partially sintered via first heating processes prior to said second heating process to sinter-braze.

17. The method of claim 10, wherein said brazing material comprises an element selected from a group consisting of: copper, nickel, boron, manganese, silicon, iron, and combinations thereof.

18. The method of claim 10, wherein said second scroll component is formed by a metallurgical process selected from the group consisting of: forging, extruding, working (wrought), casting, and combinations thereof.

19. The method of claim 1, wherein said first heating process and said second heating process are conducted for a combined duration of about 3 or more hours.

20. A method of forming a scroll member comprising:

heating a hub scroll component comprising a powder metal material comprising an iron alloy comprising carbon at greater than or equal to about 0.4 to less than or equal to about 0.6% by weight in a furnace having a temperature of greater than or equal to about 1,900° F. (1,037° C.) for at least partial sintering during a first heating process;

cooling said hub scroll component, wherein after said first heating process and said cooling said iron alloy has greater than or equal to about 99% by weight of a total amount of carbon remaining in said iron alloy in a form bound to and/or reacted with at least one species in said iron alloy that minimizes carbon migration;

disposing a brazing material in a joint interface region formed between a portion of said hub scroll component and a portion of a second scroll component defining a baseplate and an involute, wherein said second scroll component comprises a second distinct iron alloy comprising carbon at greater than or equal to about 0.7 to less than or equal to about 0.9% by weight; and heating to sinter-braze said hub scroll component and said second scroll component having said brazing material therebetween in a furnace having a temperature of greater than or equal to about 1,900° F. (1,037° C.) in a second heating process to form the scroll member having a braze joint coupling said portion of said hub scroll component to said portion of said second scroll component.

* * * * *